United States Patent [19]

Zukas et al.

[11] 4,214,498

[45] Jul. 29, 1980

[54] WOOD CUTTING APPARATUS

[76] Inventors: Peter W. Zukas; William Zukas, both of Smithville Rd., Spencer, Mass. 01562

[21] Appl. No.: 951,186

[22] Filed: Oct. 13, 1978

[51] Int. Cl.[2] ..... B27B 17/02

[52] U.S. Cl. ..... 83/796; 83/574; 83/544

[58] Field of Search ..... 83/796, 798, 797, 574, 83/544

[56] References Cited

U.S. PATENT DOCUMENTS

| | | | |
|---|---|---|---|
| 2,316,996 | 4/1943 | Smith | 83/796 |
| 2,851,067 | 9/1958 | Greenslate | 83/796 |
| 3,433,277 | 3/1969 | Ribley | 83/796 |
| 4,123,957 | 11/1978 | Niemela et al. | 83/574 X |

*Primary Examiner*—Donald R. Schran

*Attorney, Agent, or Firm*—Norman S. Blodgett; Gerry A. Blodgett

[57] ABSTRACT

Apparatus for supporting and operating a chain saw, including a table for supporting wood to be cut and an elongated actuating arm mounted on the table.

7 Claims, 3 Drawing Figures

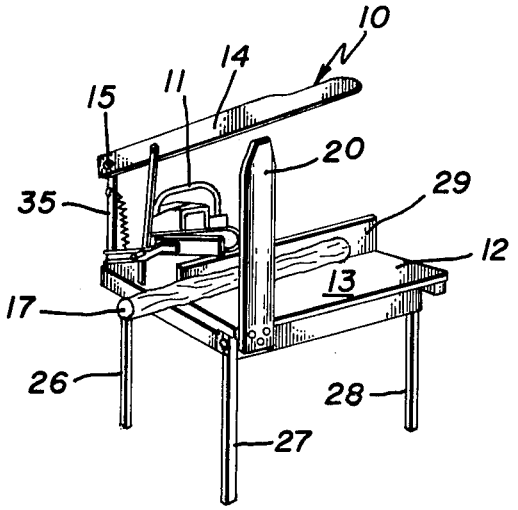
Fig. 1
Fig. 3
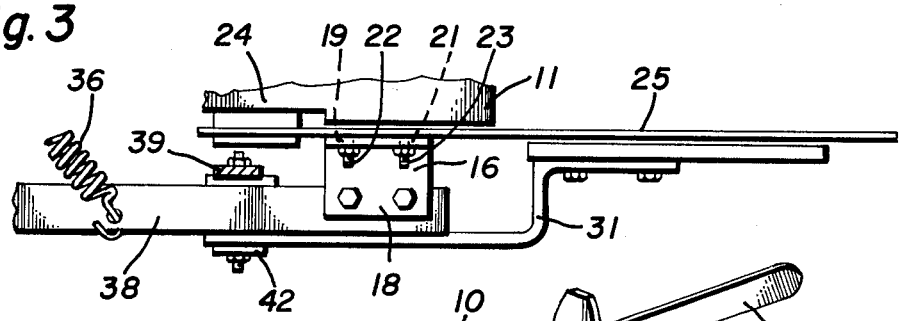
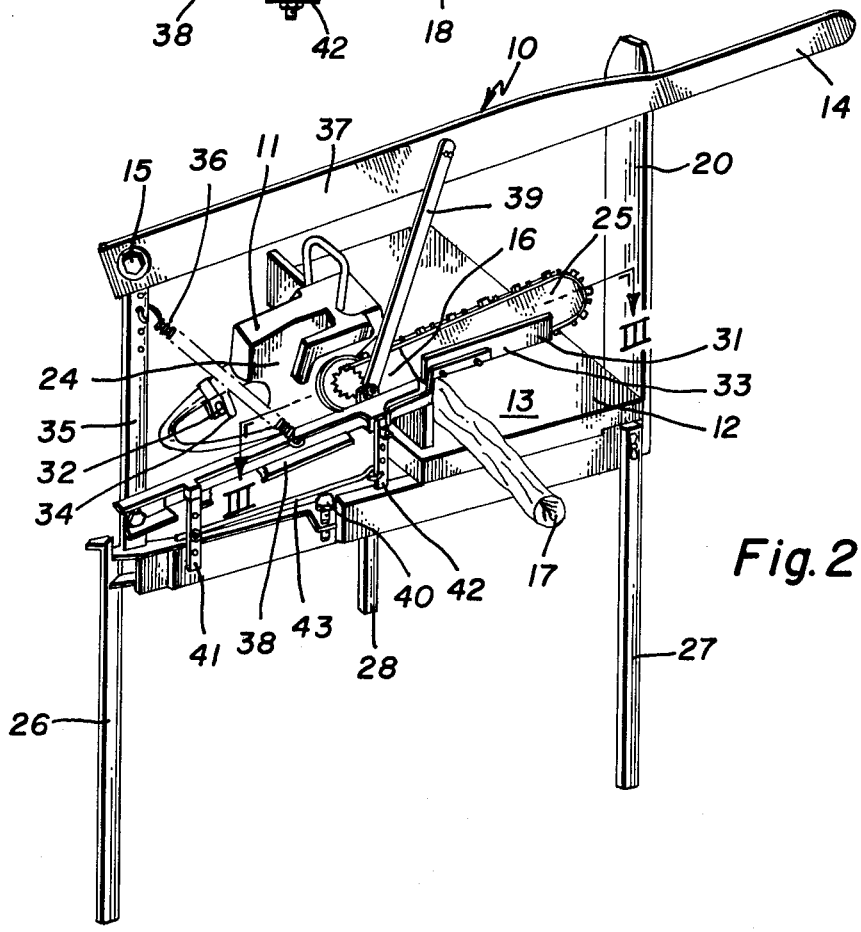
Fig. 2

WOOD CUTTING APPARATUS

BACKGROUND OF THE INVENTION

The standard chain saw, which is operated by a small gasoline engine, has reached a stage in its development at which it is practically fool-proof and, therefore, is very popular. Small gasoline engines have been developed to the point where they run smoothly and are easy to start. The modern saw itself is formed of lightweight, durable metal, so that its weight is quite small. For that reason, the chain saw has become the tool of choice for cutting wood for domestic use. It is ideal for work in a wood lot for producing cord wood in four foot lengths and the like. Many stoves and fireplaces, however, use short lengths of wood, so that it is necessary that the homeowner cut the longer lengths into shorter stove lengths. While the chain saw is ideal for cutting standing timber, it requires two hands to operate it, so that two persons have been necessary to cut larger pieces into smaller pieces; one person is needed to operate the chain saw and the other person to hold the wood. Since a homeowner does not always have a "helper" to assist him, he may try the dangerous operation of trying to hold the wood in one hand and operate the saw with the other. These and other difficulties experienced with the prior art devices have been obviated in a novel manner by the present invention.

It is, therefore, an outstanding object of the invention to provide a wood cutting apparatus that includes means for holding and operating a chain saw, so that one hand is free to manipulate the wood.

Another object of this invention is the provision of an apparatus enabling a single person to cut long pieces of wood into shorter lengths.

A further object of the present invention is the provision of an apparatus permitting a chain saw to be used in cutting short lengths of wood without danger to the user.

It is another object of the instant invention to provide a table-type saw that uses a chain saw already owned by the user.

A still further object of the invention is the provision of wood cutting apparatus which is simple to use, which is inexpensive to manufacture, and which is capable of a long life of useful service with a minimun of maintenance.

Another object of the invention is the provision of chain saw apparatus which can be folded for storage in a small space and which is light in weight.

With these and other objects in view, as will be apparent to those skilled in the art, the invention resides in the combination of parts set forth in the specification and covered by the claims appended hereto.

SUMMARY OF THE INVENTION

In general, the invention consists of a wood cutting apparatus, including a table providing a horizontal surface at a working height. An elongated arm is pivotally mounted on the table for hinged motion about a horizontal axis that extends through one end of the arm at one side of the surface. The other end of the arm is located at the other side of the table. Means is provided for fastening a chain saw to the arm, so that downward pivotal movement of the said other end of the arm causes the saw to engage a piece of wood supported on the table surface.

More specifically, the fastening means consists of a plate forming part of the arm, the plate having two apertures to receive the two threaded bolts extending from the body of the saw to hold the chain blade of the saw, the bolts receiving nuts to hold the body, blade, and plate together. An actuator is provided to operate the trigger of the saw to speed up the saw, as the arm is swung downwardly. A vertical post extends upwardly from the table and the arm is pivotally connected to it, while a spring extends from the post to the arm to maintain it normally in an upper inoperative postion. The arm consists of a primary handle portion pivoted to the top of the post and operated by the hand of the user and a secondary portion pivoted to an intermediate part of the post and held in spaced parallel relationship to the primary portion by a link joining the two, the secondary portion carrying the chain saw.

BRIEF DESCRIPTION OF THE DRAWINGS

The character of the invention, however, may be best understood by reference to one of its structural forms, as illustrated by the accompanying drawings, in which:

FIG. 1 is a perspective, generally-frontal view of a wood cutting apparatus embodying the principles of the present invention, FIG. 2 is a perspective view taken from one side of the apparatus, and FIG. 3 is a horizontal sectional view of the apparatus taken on the line III—III of FIG. 2.

DESCRIPTION OF THE PREFERRED EMBODIMENT

Referring first to FIG. 1, wherein are best shown the general features of the invention, the wood cutting apparatus, indicated generally by the reference numeral 10, is shown in use in cutting a piece of wood, such as a log 17, into smaller pieces by use of a gas-powered chain saw 11. The apparatus is provided with a table 12 having a horizontal surface 13, the surface being located at waist height from the ground in manner suitable for working. An elongated handle 14 overlies the table and is pivotally mounted on it. This allows hinged motion about a fixed horizontal axis, as defined by a pivot pin 15 extending through one end of the arm at one side of the table. The other end of the arm extends over the other side of the table, which might be considered as the "front" side. A fastening means 16 is provided to connect the handle 14 to the chain saw 11, so that downward movement of the handle 14 causes the chain saw 11 to engage and cut the log 17 supported on the surface 13 of the table 12. A guard 20 extends up the front side of the table.

Referring to FIGS. 2 and 3, which show the details of the invention, the fastening means is shown as being in the form of an angle plate 18 fastened to the arm. The vertical portion of the plate is provided with two apertures 19 and 21 for receiving the two threaded bolts 22 and 23 extending from the body 24 of the standard chain saw for holding the chain blade 25. The bolts receive nuts to clamp the body 24, the blade 25, and the plate 18 together.

The table 12 is provided with legs 26, 27, and 28 to support it on irregular gound and has a vertical fence 29 that defines a corner with the surface 13 for locating and holding the log 17 under the saw. An actuator 31 is provided to operate the trigger 32 of the saw and to accelerate the engine and the chain as the arm 14 is swung downwardly. The actuator 31 includes a lever 33 which is pivotally mounted on the handle 14 and is biased to a position lying at a substantial angle below the handle, so that, as the handle is moved downwardly, the lever 33 first engages the log 17 and is moved toward the handle. The movement of the lever relative to the handle causes a finger 34 to press the trigger.

A vertical post 35 extends upwardly from the rear of the table, the handle 14 being pivotally connected to its upper end by the pivot pin 15. A coil spring 36 maintains the handle in an upper, inoperative position.

Handle 14 is a complex structure consisting of an upper primary arm 37 which, as has been stated, is pivotally attached by the pivot pin 15 to the upper end of the post 35. It also includes a lower secondary arm 38 which is pivoted to a lower part of the post 35. A link 39 joins the primary arm 37 to the secondary arm 39 to hold the arms in spaced parallel relationship, the post 35, the link 39, the primary arm 37, and the secondary arm 39 forming a 4-bar linkage. The chain saw 11 is fastened to and supported by the secondary arm 38 and the spring 36 joins the secondary arm to the post 35. The actuator 31 includes two bell cranks 41 and 42 pivotally mounted on the secondary arm 38 and extending downwardly therefrom to lie in spaced parallel relationship. They are joined by a link 43 so as to swing in synchronization with the movement of the lever 33. The finger 34 is keyed to the pivotal axis of the bell crank 41 to swing with it. An adjustable stop 40 is provided to limit the downward movement of the arm 38.

The operation and the advantages of the present invention will now be readily understood in view of the above description. The chain saw 11 is first started up, so that its gasoline engine is idling smoothly. At that time, in accordance with the usual constructions of chain saws, the chain does not move; it requires a degree of acceleration of the gasoline engine (by means of the trigger 32) to cause the engine to speed up. A centrifical clutch then causes the chain to move around the blade 25. The operator stands in front of the table 12 and grasps the handle 14; more specifically, he holds the outer end of the primary arm 37. Normally, he would do this with his left hand while his right hand feeds the log 17 along the corner defined by the surface 13 and the fence 29 of the table 12. When the log 17 has been spaced in such a way that a suitable length extends over the edge of the table, the operator pulls down on the handle 14 and brings the saw 11 toward the log 17. As the handle 14 moves downwardly, its secondary arm 38 moves in a similar way, carrying the saw with it. Before the blade of the saw reaches the log 17, however, the log is engaged by the lever 33. The lever moves upwardly against a spring bias toward the lower edge of the blade 25 of the chain saw. The movement of the lever relative to the secondary arm 38 causes the bell crank 42 to rotate (counter-clockwise in FIG. 3), carrying the bell crank 41 with it, because of the link 43. The rotation of the bell crank 41 causes the finger 34 to press against the trigger 32 of the chain saw, thus causing the gasoline engine to speed up. As the lever 33 is pressed upwardly into alignment with the bottom edge of the chain saw, the higher speed of the engine causes the chain to move rapidly around the blade 25. By the time the chain reaches the upper surface of the log 17, it has been speeded up to the point where it makes a cut in the usual way. Continuing movement of the handle 14 causes the chain saw to cut the log and the severed piece falls off the edge of the table. The cycle is repeated as long as is necessary to cut the log 17 into suitable shorter lengths. When the handle 14 is released, the spring 35 carries it upwardly again and carries the chain saw with it. Actually, the lever 33 is spring-biased to a position lying at a substantial angle below the bottom edge of the chain saw. The same spring returns the finger 34 and the remainder of the equipment, including the bell cranks 41 and 42, to their original inoperative positions.

It can be seen, then, that the present apparatus involves a relatively simple construction for converting an ordinary chain saw to a suitable table saw for cutting logs into shorter lengths. A single person is able to operate the equipment, since only one hand is necessary to lower the chain saw, while the other hand feeds the material such as the log 17, toward the cutting position. In this way, the user of the chain saw is not tempted to try to hold the chain saw with one hand and support the log also, thus entering into a dangerous situation. When it is desirable to use the chain saw in its conventional way in the wood lot, it is only necessary to loosen the nuts and remove the chain saw from the plate 16. The nuts are then returned to the bolts 22 and 23, so that the chain saw can be operated in the usual way as an individual unit. The entire apparatus can be inexpensively manufactured from standard metal stock and with wooden parts.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Wood cutting apparatus, comprising:
(a) a table providing a horizontal surface at a working height,
(b) a vertical post extending upwardly from the table,
(c) an elongated primary arm pivotally mounted to the upper end of the post for hinged motion about a horizontal axis extending through an end of the arm at one side of the surface and having its other end located at the other side of the table, said primary arm including a handle position,
(d) a secondary arm pivoted to the lower part of the post,
(e) a link pivotally connected to the primary and secondary arms to hold them in spaced parallel relationship,
(f) means for fastening a chain saw to the secondary arm so that downward pivotal motion of the primary and secondary arms causes the saw to engage a piece of wood supported on said horizontal surface, and
(g) a spring for maintaining the primary and secondary arms in an upper inoperative position.

2. Wood cutting apparatus as recited in claim 1, comprising an actuator including a lever pivotally mounted on the secondary arm and biased to a position lying below the cutting chain of a chain saw mounted on the apparatus, said actuator also including a finger operatively connected to the lever for engaging the trigger of the saw, so that, as the secondary arm is moved downwardly, the lever first engages the piece of wood and is moved toward the cutting chain and the finger is caused to press the trigger.

3. Wood cutting apparatus as recited in claim 2, wherein the means for operatively connecting the lever to the finger comprises:

(a) a pair of bell cranks pivotally mounted on the secondary arm in spaced parallel relationship, one of the bell cranks being keyed to the pivotal movement of the lever and the finger being keyed to the pivotal movement of the other bell crank, and (b) a link connecting the bell cranks so that they move in synchronism.

4. Wood cutting apparatus as recited in claim 1, wherein the fastening means consists of a plate forming part of the secondary arm, the plate having two apertures to receive two threaded bolts extending from the body of the saw to hold the chain blade of the saw, the bolts receiving nuts to hold the body, blade, and plate together.

5. Wood cutting apparatus as recited in claim 1, wherein the table is provided with legs to support the horizontal surface and a vertical fence defining a corner for retaining the piece of wood.

6. Wood cutting apparatus, comprising:

(a) a table providing a horizontal surface at a working height, (b) an elongated arm pivotally mounted on the table for hinged motion about a horizontal axis extending through one end of the arm at one side of the surface and having its other end located at the other side of the table, said arm including a handle portion, (c) means for fastening a chain saw for synchronous movement with the arm so that pivotal movement of the arm causes the cutting portion of the saw to move from an inoperative position above a piece of wood supported on said horizontal surface to an operative position in engagement with said wood, (d) an actuator mounted for synchronous movement with the arm and including a lever mounted for pivotal movement relative to the arm, said lever being biased to a position lying below the cutting portion of a chain saw mounted on the apparatus, said actuator also including a finger operatively connected to the lever for engaging the trigger of the chain saw so that as the arm is moved downwardly, the lever first engages the piece of wood and is moved toward the cutting chain and the finger is caused to press the trigger.

7. Wood cutting apparatus as recited in claim 6, comprising means for biasing the elongated arm to said inoperative position.

* * * * *